US006213722B1

(12) United States Patent
Raos

(10) Patent No.: US 6,213,722 B1
(45) Date of Patent: Apr. 10, 2001

(54) SUCKER ROD ACTUATING DEVICE

(76) Inventor: Davor Jack Raos, 2151 Riviera Dr., Vista, CA (US) 92084

( * ) Notice: Subject to any disclaimer, the term of this patent is extended or adjusted under 35 U.S.C. 154(b) by 0 days.

(21) Appl. No.: 08/623,549

(22) Filed: Mar. 29, 1996

(51) Int. Cl.[7] ..... F04B 17/04
(52) U.S. Cl. ..... 417/53; 417/417
(58) Field of Search ..... 417/53, 416, 417; 166/68.5

(56) References Cited

U.S. PATENT DOCUMENTS 1,693,114 * 11/1928 Heany ..... 417/416
1,840,994 * 1/1932 Winsor ..... 417/417
3,437,043 * 4/1969 Sanders et al. ..... 417/416
5,193,985 * 3/1993 Escue et al. ..... 417/53

* cited by examiner

*Primary Examiner*—Charles G. Freay
(74) *Attorney, Agent, or Firm*—Timothy J. King

(57) ABSTRACT

The present invention provides a device for actuating a sucker rod pump assembly, the device comprising an electric linear motor positioned about the axis of operation of the sucker rod pump and a counterbalance positioned such that it counterbalances the weight of the sucker rod assembly and the liquid being pumped. The present invention also provides a method for pumping a fluid utilizing a sucker rod assembly, an electric linear motor and a counterbalance.

16 Claims, 9 Drawing Sheets

FIGURE 7
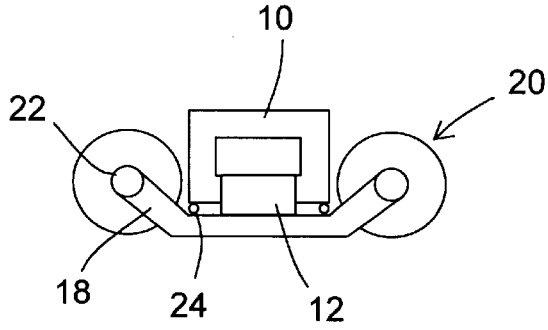
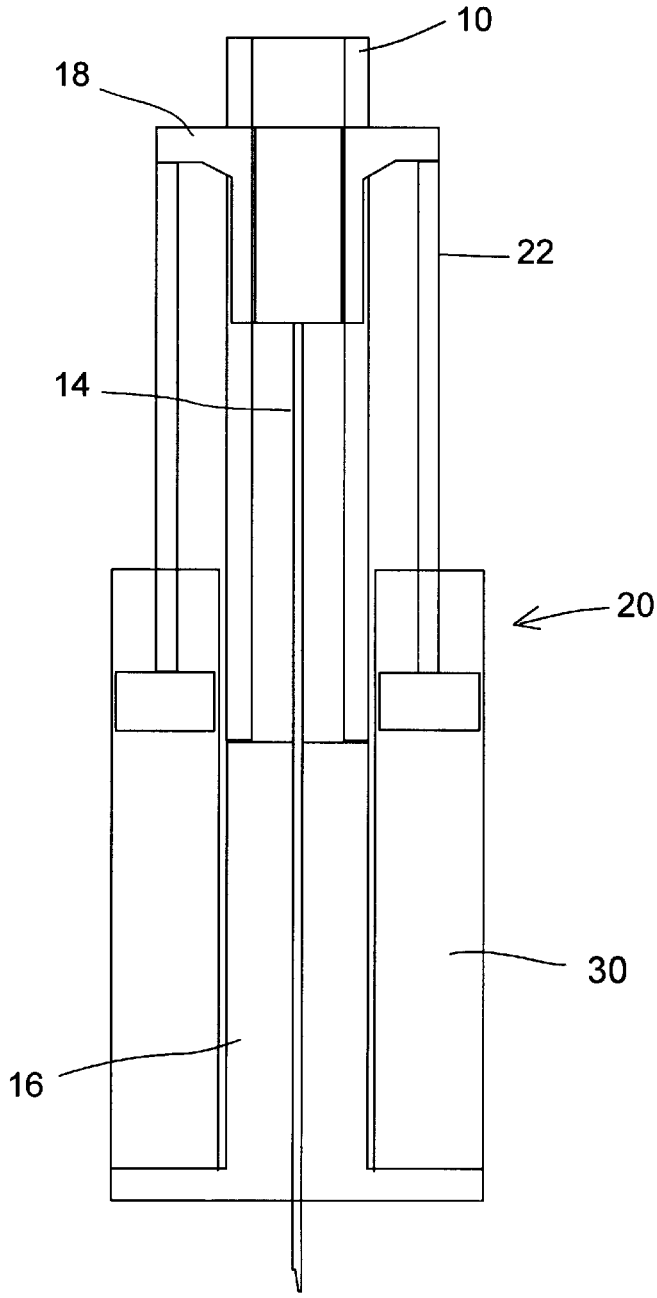
FIGURE 6

SUCKER ROD ACTUATING DEVICE

BACKGROUND OF THE INVENTION

The present invention is directed to new devices and methods for actuating a sucker rod pump. Many methods of actuating sucker rods have been proposed. While their use is not limited to only oil wells, sucker rods are particularly well adapted for use therein. It follows that many methods of actuating sucker rods for oil wells have also been proposed.

Of all the methods of actuating sucker rods for pumping oil previously proposed, the walking-beam surface unit is the most utilized device for actuating sucker rods because of its superior efficiency. This device, a representation of which is set forth in FIG. 1, typically utilizes an electric rotary motor 24 in conjunction with a speed-reduction gear box 26 to oscillate a walking beam 34 by means of a crank 27 and pitman 32. This construction converts the rapid rotational motion of the motor 24 into the relatively slow, reciprocating or oscillating motion of the walking-beam 34. The oscillating motion of the walking-beam 34 is transferred to the polished rod 10 and so to the subsurface pump 16, by means of a hanger cable 36 suspended from the end of the walking beam 34 opposite the crank 27 and pitman 32. The result is oil pumped at relatively low operating and capital costs.

This technology has been ubiquitous in oil fields for decades. See Lester Charles Uren, *Petroleum Production Engineering*, McGraw-Hill Book Company, Inc. New York (1939). Yet, despite the walking-beam surface unit being one of the most efficient devices heretofore available for actuating a sucker rod pump, the design is nevertheless inherently inefficient and inflexible. The present invention is directed to actuating a sucker rod pump with much greater efficiency than this decades-old technology.

With respect to the walking unit's inefficiencies, the electrical rotary motor 24, used as a prime mover, operate efficiently: at about 85% efficiency. However, the mechanical conversion of its high-speed, rotary motion by the speed-reduction gear box 26 to the slow, reciprocating motion needed to actuate the rods results in significant energy losses. The energy loses include friction losses in the gear box. Indeed, the gear box is only about 50% efficient. Other energy loses include friction losses in the bearings associated with the crank, pitman, and walking-beam.

In addition to the mechanical inefficiencies in the walking-beam surface unit, it has substantial design limitations which translate into high operating costs, operating costs which are substantially reduced, if not eliminated, by the present invention. For example, as FIG. 1 demonstrates, the walking-beam surface unit has a significant amount of articulation. As with most highly articulated mechanical devices, this conventional walking-beam surface unit tends to fail on a frequent basis. Moreover, this tendency of highly articulated mechanical systems, such as the walking-beam surface unit, to break down is exacerbated by severe environments. As significant amount of oil production occurs in the desert (Middle East), in the tundra (Alaska, Siberia) and on the open ocean (North Sea), it follows that the maintenance difficulties, and associated costs, are legion.

In addition to the likelihood of the walking-beam surface unit failing, the remoteness of such units adds an additional dimension to the cost of maintaining them. The units must be constantly tended to by manned crews to prevent lost production from unit failure. The prior art system has no capability to provide an operator with a remote diagnosis, adjustment or maintenance. Routine, manned maintenance is the only manner to insure that the pumps are working and working to their maximum potential.

Another design limitation of the walking-beam surface unit which adds to its cost of operation is the inflexible nature of its operation. Adjustments of the stroke length of the sucker rod are required when a well is set up and periodically thereafter. Unfortunately, such adjustments are difficult to make on the conventional walking-beam surface unit. Stroke-lengths can be varied through a typical range of only six fixed increments. Any time the stroke length is changed, the rig must be dismantled. Dismantling the heavy iron rig to vary the position of the pitman connection in the crank arm is tedious, labor-intensive work.

In addition to the difficulty in adjusting the stroke length, there is no easily operable facility on the conventional walking-beam surface unit for adjusting the speed, measured in strokes per minute, of the sucker rod pump. The ability to easily adjust the speed of the sucker rod pump is a desirable feature as it would facilitate operating the sucker rod pump in a variety of conditions. Also, it is desirable to pump some wells intermittently, yet the design of the conventional walking-beam surface unit does not facilitate intermittent operation, since the mechanical system tends to "freeze" once stopped and it is difficult and time-consuming to restart it.

In addition to the difficulty in making adjustments in the walking-beam surface unit, the fixed and non-adjustable, adjustable, sinusoidal deceleration/acceleration profile of the conventional walking-beam surface unit is not optimum for the operation of a sucker rod pump. The conventional profile imposes shock loading on the system, stressing the gear box and associated power train and results in excessive sucker rod vibration and consequently in accelerated rates of surface unit and sucker rod wear and failure.

Another significant disadvantage of the conventional walking-beam surface unit design is its use of a flexible hanger cable 36 to attach the polished rod 10 to the walking beam 34 (See FIG. 1). Lack of a rigid connection between the surface unit of an oil pumping rig and the sucker rod string invites excessive vibration and rapid stress variation in the sucker rod string.

Various modifications have been proposed to eliminate some of the difficulties discussed above with the conventional walking-beam surface unit. However, they all have resulted in undesirable compromise: they have addressed some of the problems but only at the expense of overall system efficiency.

Recently, a linear motor has been proposed as a replacement for the rotary motor, gearbox, and crank of conventional walking-beam surface units. As disclosed in U.S. Pat. No. 5,409,356 issued to Massie, it has been suggested to use a linear motor to oscillate the walking-beam of a conventional type surface unit, thus eliminating the rotary motor, gearbox, crank, and pitman. This modification of a conventional walking-beam type surface unit is aimed primarily at removing the inefficiency of the gearbox and giving the possibility of easy stroke length and acceleration/deceleration profile adjustment.

A main feature of the well pumping system disclosed in Massie is its improved flexibility due to the use of a linear motor to oscillate the beam. For example, stroke-length adjustments required in setup and ongoing operation of oil pumping units are easily afforded with a linear motor. Necessary adjustments in pumping speed (strokes per minute) are also easily accomplished in the Massie device. Finally, the linear motor-driven beam pumping system is relatively well-suited to the need for intermittent operation, since it lacks a gearbox, crank, and pitman and their attendant restarting difficulties.

However, the adaptation of a linear motor to a conventional walking-beam design as proposed by Massie results in a very inefficient system in terms of power consumption. The Massie device employs an electro-regenerative system as the primary means of static load counterbalancing. In this system, the linear motor would be operated as a generator on the down stroke of the sucker rods, the energy of the falling rod string thus producing electric power. This electrical energy is then stored in a battery or similar device. On the upstroke, when the machine is lifting the dead weight of the rod string and oil column, the linear motor draws upon the energy stored in the battery.

This type of counterbalancing system is very inefficient due to the accumulated energy losses incurred in generation, switching, storage, retrieval and finally, motor losses. Since the static load in a sucker rod system is usually great, efficient counterbalancing is critical. Energy efficiency of the Massie device would therefore appear to be seriously compromised.

Whereas Massie proposes a modification of a conventional walking-beam surface unit to include a linear motor, the present invention comprises a completely new surface unit design and concept which solves the problems of the prior art.

SUMMARY OF THE INVENTION

The present invention provides a device for directly actuating a rod of a sucker rod pump assembly, the device comprising an electric linear motor, the motor including an armature, stators and a base and positioned about the axis of operation of the sucker rod pump, wherein the motor armature is connected to the top end of the rod; and a counterbalance in contact with the armature.

The present invention further provides a device for pumping fluid, the device comprising a sucker rod pump assembly, the assembly including a rod; an electric linear motor, the motor including an armature, stators and a base, and positioned such that it operates on substantially the same axis as the rod traverses, wherein the armature is connected to the rod; and a counterbalance positioned such that it counterbalances the weight of the sucker rod assembly and the liquid being pumped.

The present invention also provides a method for pumping a fluid utilizing a sucker rod assembly, an electric linear motor and a counterbalance, the sucker rod assembly including a rod and the electric linear motor including an armature, stators and a base, the method comprising positioning the sucker rod pump assembly such that the pump contacts a fluid reservoir; positioning the linear motor such that its axis of operation is substantially the same as the axis of movement of the sucker rod; attaching the top end of the sucker rod to the armature of the linear motor such that when operable the armature directly drives the rod; providing a counterbalance positioned such that it alleviates the load imposed on the linear motor by the sucker rod and the column of fluid to be pumped; and operating the motor such that the pump acquires fluid on its down stroke and transports fluid on its up stroke.

BRIEF DESCRIPTION OF THE FIGURES

FIG. 6 provides a side view of a linear motor pump with a pneumatic counterbalance.

FIG. 7 provides a top view of the linear motor pump of FIG. 6.

DETAILED DESCRIPTION OF THE INVENTION

Figure 1:
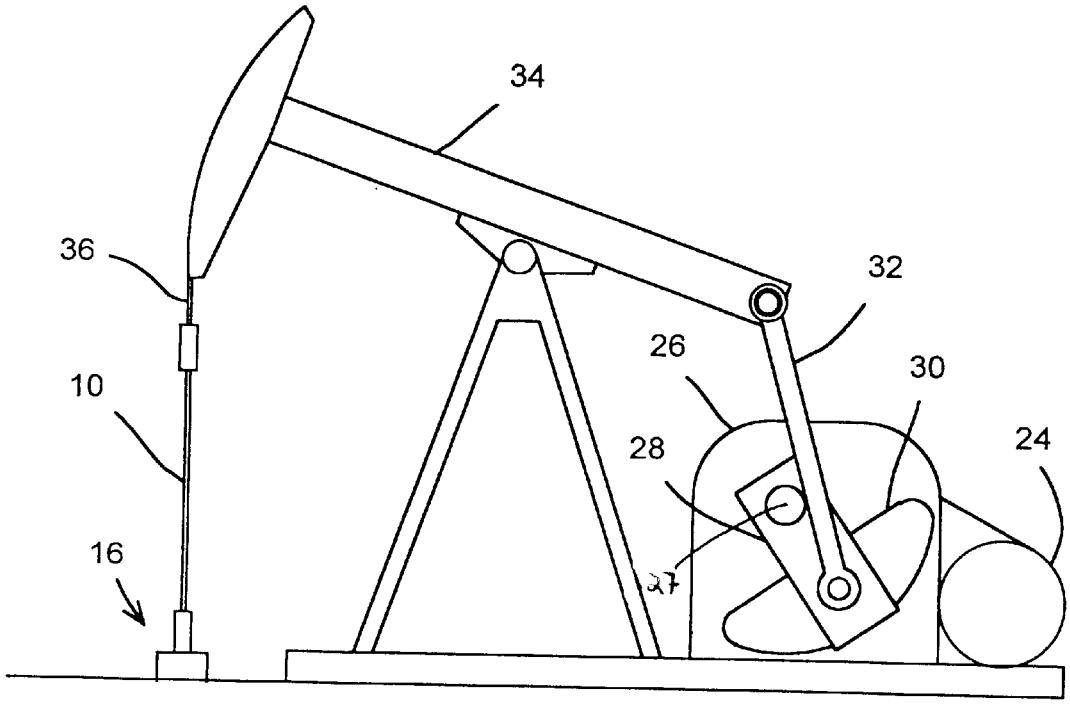
FIG. 1 PRIOR ART
FIG. 1 provides a view of the prior art walking-beam surface unit.

The present invention provides an improved device for directly actuating the rod of a sucker rod pump assembly. The device improves upon the prior art by using an electric linear motor to directly drive the pump rod. The armature is fixed directly to the rod or via a connecting rod. The linear motor, which traverses along a single axis, Y, would be positioned relative to the sucker rod pump assembly such that the axis upon which the sucker rod pump traverses while in operation, Y', would preferably be coaxial or at least substantially similar to that of Y. Some variation in positioning of the motor relative to the rod may necessitate that Y would not coaxial to Y'. Such a situation is encompassed by the present invention. In addition, a counterbalance, attached to the linear motor armature, is contemplated for the present invention so the linear motor may operate more efficiently than the prior art allows.

In a preferred embodiment, at least a portion of the counterbalance is positioned between the armature and the base of the linear motor. Most preferably, the counterbalance includes a mechanical spring. Most preferably, the spring is positioned within the linear motor and one end of the spring contacts the armature and the other end contacts the base of the linear motor, such that upon the linear motor's down stroke, the spring is compressed.

In another embodiment of the present invention, counterbalances envisioned include pneumatic or hydraulic cylinders or some combination thereof. Such counterbalances would preferably be positioned in a manner similar to the mechanical spring.

In another embodiment of the present invention, the counterbalance may be fixed to the armature. Where the counterbalance is fixed to the armature, the counterbalance includes a flexible cable, one end of which is fixed to the armature, an idler pulley which supports the cable and a counterweight fixed to the other end of the flexible cable. It is further contemplated that a combination of a mechanical spring with a counterbalance fixed to the armature may be beneficial.

The present invention provides a device for actuating a sucker rod assembly in combination with a counterbalance and a linear motor wherein the counterbalance is located below the linear motor. Indeed, it is contemplated in one embodiment of the present invention where one end of counterbalance, e.g., a spring, is fixed to a portion of the rod near the upper terminus of the pump assembly and the other end is set below and around the rod assembly. The spring's second end would abut a support which would limit that end of the spring's ability to move upon the down stroke of the rod. In such an embodiment, the mechanical spring would provide a counterbalance to the weight of the sucker rod assembly and the column of fluid as would the embodiment provided in FIG. 2. This embodiment might facilitate the replacement of motors as well as lessen the expense of such motors.

In a preferred embodiment of the present invention, the device for actuating the reciprocating load also includes a motor controller. Motor controllers which are known to those of ordinary skill in the art are contemplated for use in the present invention.

In a preferred embodiment, the linear motor is comprised of a permanent magnet armature and a multiple electromagnet stator. The electromagnets are sequentially energized by solid state switches, in such a way as to draw the armature from one end of the stator bank to the other. The impulse provided to the armature by any given electromagnet can be varied, by pulse width modulation for example, in order to adjust the speed, acceleration/deceleration profile and stroke length of the pump system. The solid state switches are controlled by a digital microprocessor, allowing machine adjustments to be made by software changes or in response to microprocessor inputs.

In a preferred embodiment of the present invention, therefore, the device for actuating the reciprocating load is computer controlled. In the most preferred embodiment, since the linear motor is electronically committed under computer control, adjustments in speed, stroke length and acceleration/deceleration curves can be easily and quickly made by reprogramming the computer, either on site or remotely, over land telephone lines, for example. It is further contemplated that the device can be remotely monitored and controlled through the use of cellular or radio technology, thereby minimizing the need for human inspection and adjustment of remote units.

Furthermore, the flexibility of a computer-controlled direct drive linear motor makes possible a self-adjusting, self-diagnostic pump system, wherein the machine automatically changes its operating mode in response to changing conditions. In such a self-adjusting system, changing conditions such as flow rate, flow composition, pump efficiency, armature thrust, etc., are electronically sensed and then analyzed by the computer in accordance with its program. The computer then automatically adjusts the commutation of the linear motor in order to optimize operation of the pump system.

The present invention also provides a method for pumping a fluid utilizing a sucker rod assembly, an electric linear motor and a counterbalance, the sucker rod assembly including a rod and the electric linear motor including an armature, stators and a base, the method comprising; positioning the sucker rod pump assembly such that the pump contacts a fluid reservoir; positioning the linear motor such that its axis of operation is substantially the same as the axis of movement of the sucker rod; attaching the top end of the sucker rod to the armature of the linear motor such that when operable the armature directly drives the rod; providing a counterbalance positioned such that it alleviates the load imposed on the linear motor by the sucker rod and the column of fluid to be pumped; and operating the motor such that the pump acquires fluid on its down stroke and transports fluid on its up stroke.

With respect to the above method, after installation of the sucker rod pump assembly, the other steps, save the last one, may be done in any random fashion and the order suggested above is not absolute. In a preferred embodiment of the method, the fluid which is petroleum or oil. However, it is contemplated that the present invention would be useful for pumping water from deep aquifers where impeller or centrifugal pumps would be too inefficient. In another preferred embodiment of the method, at least a portion of the sucker rod assembly is below the surface of the earth (subsurface).

DESCRIPTION OF THE EMBODIMENTS

Figure 2:
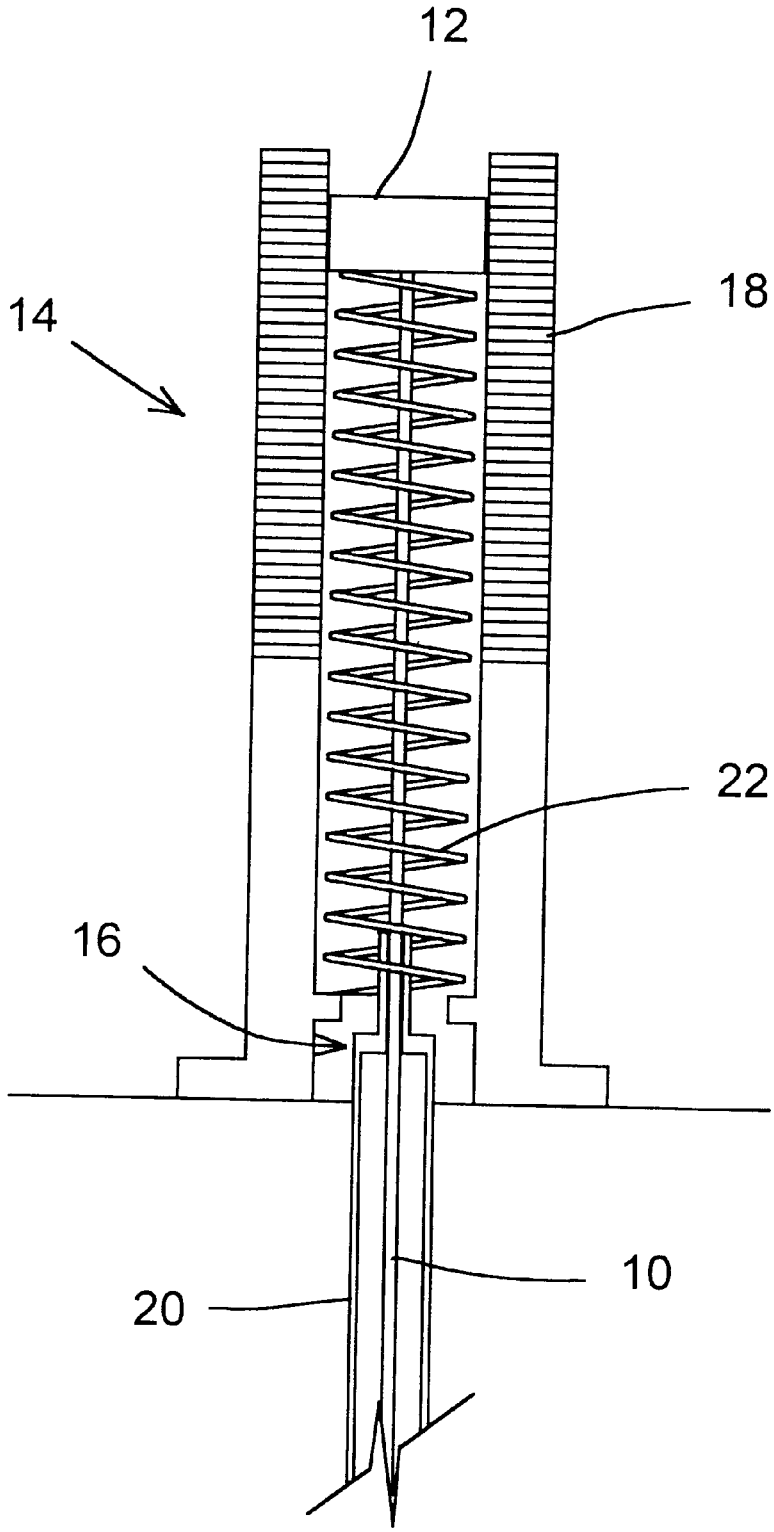
FIG. 2 provides a sectional view of the present invention, wherein a mechanical spring element is used as a counterbalance.

The instant invention provides for the direct drive of a reciprocating load and specifically, a sucker rod assembly. As FIG. 2 provides, the polished rod 10 of a sucker rod pump is connected directly to the armature 12 of a linear motor 14, which is positioned directly over the well head 16. The armature 12 is actuated by the stator 18. This system allows for the direct drive of the polished rod 10 in the well casing 20. By achieving direct drive, the walking-beam 34, flexible cable 36, pitman 32, crank 27, crank arm 28, gearbox 26, and rotary motor 24 of prior art systems are eliminated.

The mechanism for counter-balancing in the instant invention can be one of several types. The preferred embodiment of the present invention, as provided in FIG. 2, comprises a helical spring element 22 as the counterbalance. The spring effect can also be provided by two or more mechanical springs, pneumatic cylinders, or hydraulic cylinders working in conjunction with a gas charged accumulator tank. Least preferred but a viable embodiment of the instant invention, is a sash-balance type counterbalance (a flexible cable, idler pulley, and counterweight) in conjunction with the direct-drive linear motor. This type of counterbalance could be utilized in place of the spring type or in conjunction with the variable force spring type.

The direct-drive nature of the surface unit of the present invention yields several important advantages over conventional walking-beam surface units. The desirability of direct, straight drive of the polished rod has long been recognized in the industry due to experience in the use of pneumatic and hydraulic cylinders as direct-drive rod actuators (See Uren, *Petroleum Production Engineering*). However, the cylinders in this type of surface unit must be driven by compressors or pumps which are themselves very inefficient, complex, and unreliable. The present invention combines the advantages of direct rod actuation with the inherent simplicity and efficiency of an electrical linear motor.

The use of spring element counterweights with a direct linear motor drive means that the instant invention actuates a sucker rod pump with essentially only one moving part. This is a significant departure from the complex systems of the past, and results in lower maintenance costs and increased reliability. Furthermore, the instant surface unit is much more compact than prior art units and therefore can be practically housed in a small, sealed enclosure. A unit thus protected from the elements can operate more efficiently, reliably, and consistently, in addition to having an appearance that is more environmentally acceptable than prior art units, which are generally considered to be an eyesore.

Figure 3:
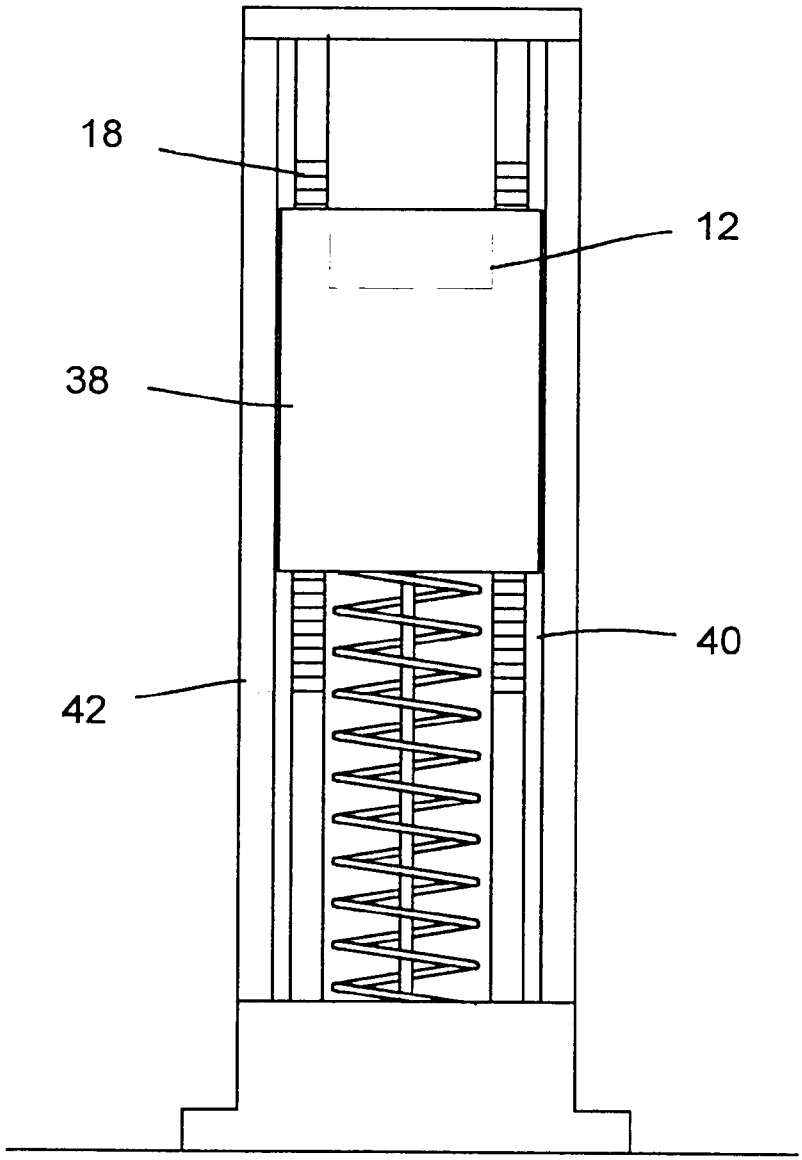
FIG. 3 provides a sectional view of the present invention setting forth the relationship of the elements of the linear motor to the mechanical spring.

The absence of any heavily loaded bearings on the instant invention will be noted. The instant invention actually contains only one bearing—a linear bearing which merely guides the reciprocating armature. FIG. 3 provides a linear bearing 38 which traverses the length of the linear motor on linear bearing rails 40, with the rails 40 supported by a linear bearing frame 42. While in close proximity, the rails 40 are independent of the stators 18 which provide the electromagnetic force to the armature 12 which bears the majority of the force vectors of the system.

Indeed, the single bearing is very lightly loaded because the major force vectors produced by the system in operation are all substantially aligned and coaxial. There is no reversal or redirection of force necessitating a heavily loaded bearing. The conventional walking-beam type surface unit requires several heavily loaded bearings.

Figure 4:
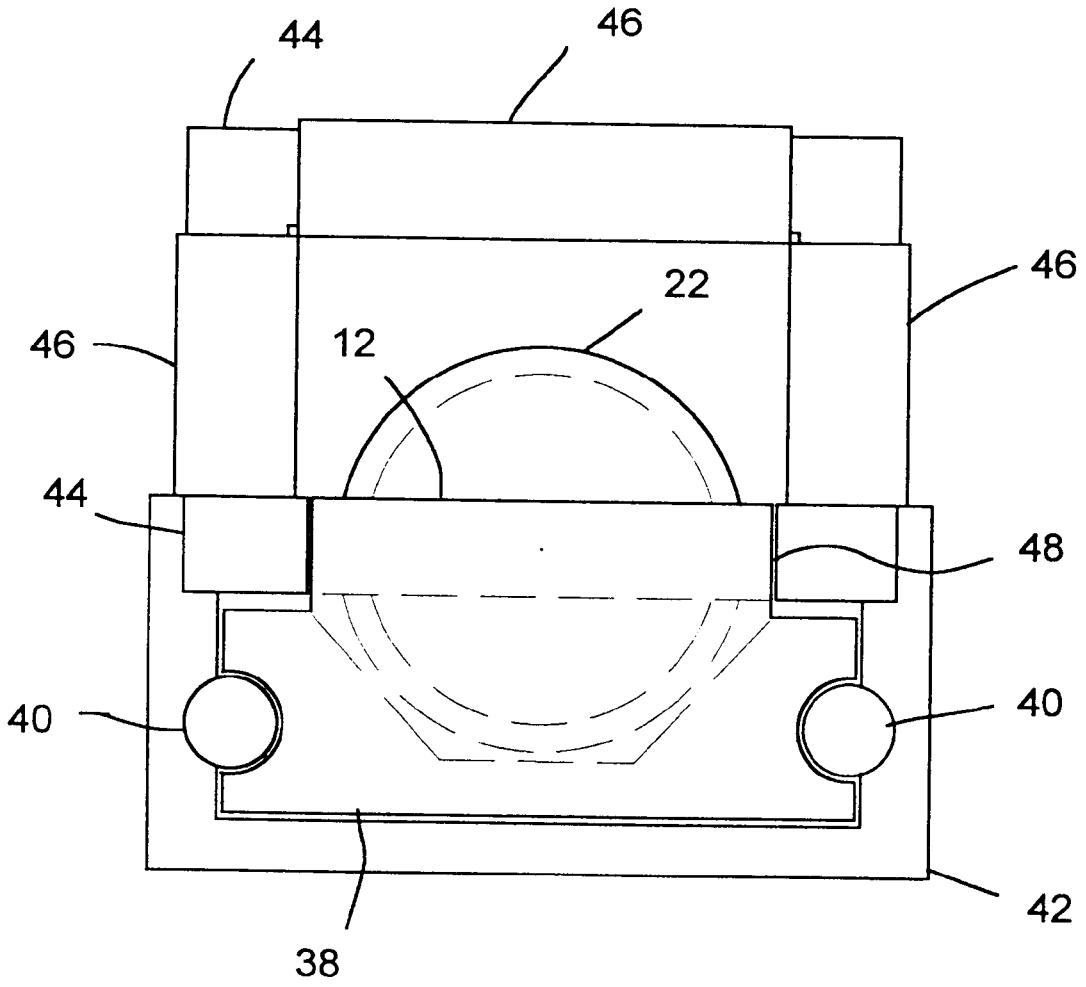
FIG. 4 provides a top end view of FIG. 3.

Heavily loaded bearings represent a compromise in mechanical design as they add cost and complexity, while reducing reliability and efficiency, of the mechanical system. FIG. 4, which provides a top end view of FIG. 3, poses a different picture than the prior art. The armature 12 and mechanical spring 22, in combination with the electromagnetic core 44, must bear the majority of force vectors. As the air gap 48 demonstrates, there is no frictional contact between the electromagnetic core 44 nor the electromagnetic winding 46 with the bearing 38. Its function is merely to keep the armature 12 equidistant from the electromotive elements of the linear motor. The result is a bearing that does not bear a heavy load as do the bearings found in conventional sucker rod pump assemblies.

The key to the superiority of the instant invention over the prior art lies in the fact that the actuating force is applied as directly as possible to the load. A linear motor must be used to achieve direct drive; however, an efficient counterbalance must also be integrated into the design. In this way, a resonant system is created, and a machine to accomplish the required task can be made simple, elegant and efficient.

Figure 5:
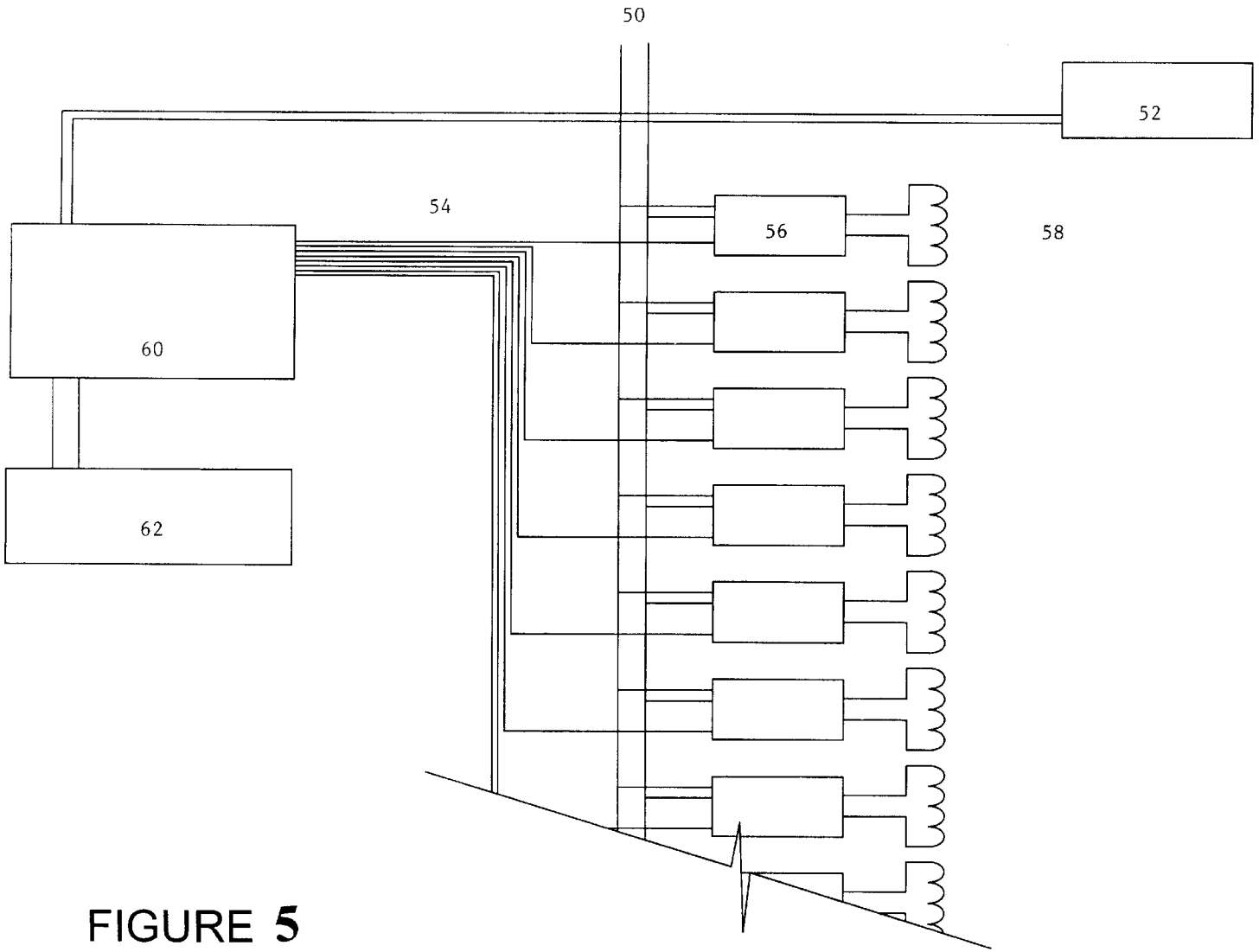
FIG. 5 provides a schematic for computer controlled linear motor.

FIG. 5 is a schematic of a computer control system for a linear motor of the present invention. It provides a cpu and program memory 60 that receives input from user interface 62. The cpu 60 controls the dispensing of power from the DC power rails 50. Power is sent if the armature position sensor 52 indicates the armature is adjacent to a particular motor winding 58. The commutation signal cable 54 sends the on-off signal from the cpu 60 to the h-bridge 56 that will turn on the power to the motor winding 58 if it receives an on signal.

FIG. 6 is a side view of a linear motor pump of the present invention with a pneumatic counterbalance. It provides a polished rod 14 attached to armature 12. Stator 10, cross arm 18, and base 16 provide the same structure earlier described. The counterbalance consists of a cylinder 20 that uses a piston rod 22 that acts upon a compressed gas 30.

FIG. 7 provides a top view of the linear motor pump of FIG. 6, including the bearings 24.

Figure 8:
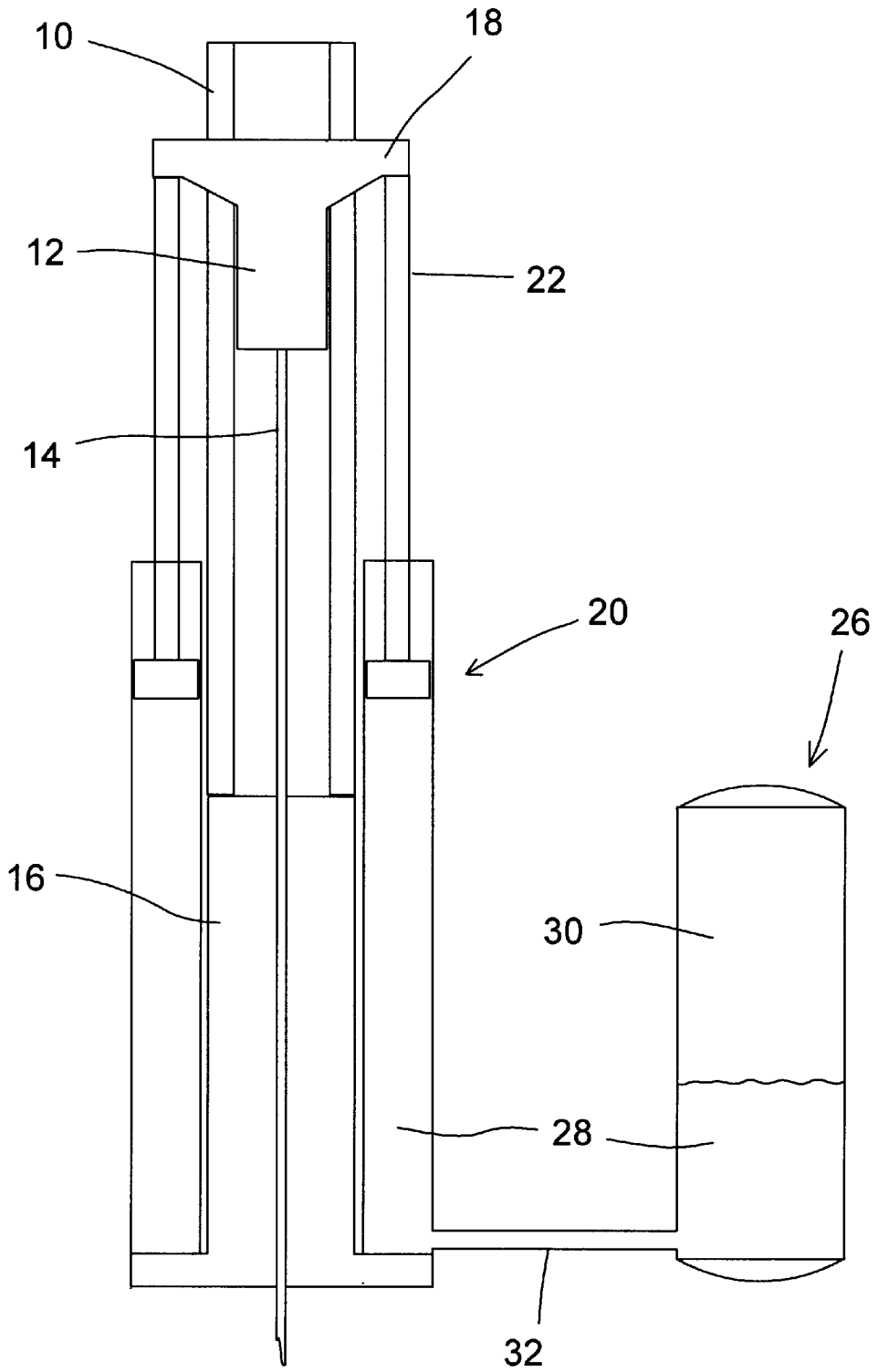
FIG. 8 provides a side view of a linear motor pump with a hydraulic counterbalance.

FIG. 8 provides a counterbalance different from that of FIG. 7. This counterbalance uses hydraulic fluid 28 that is fed through a hydraulic fluid transfer conduit into a hydraulic accumulator 26. As the piston 22 moves down the cylinder 20, the compressed gas 30 becomes more compressed, thereby providing a counterbalancing force.

Figure 9:
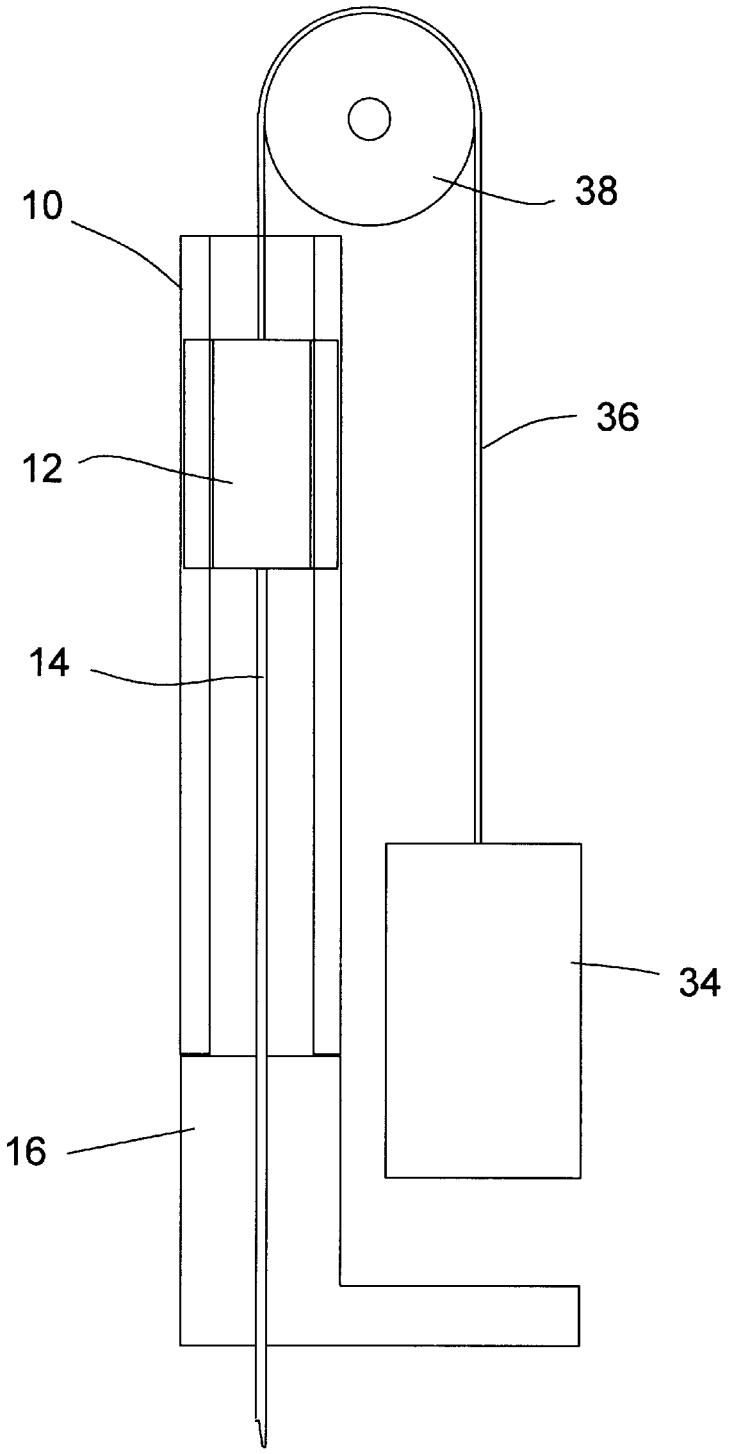
FIG. 9 provides a side view of a linear motor pump with a sash weight counterbalance.

FIG. 9 provides a counterbalance comprised of a pulley 38, over which flexible cable 36 is attached to the armature 12 and counterweight 34.

Figure 10:
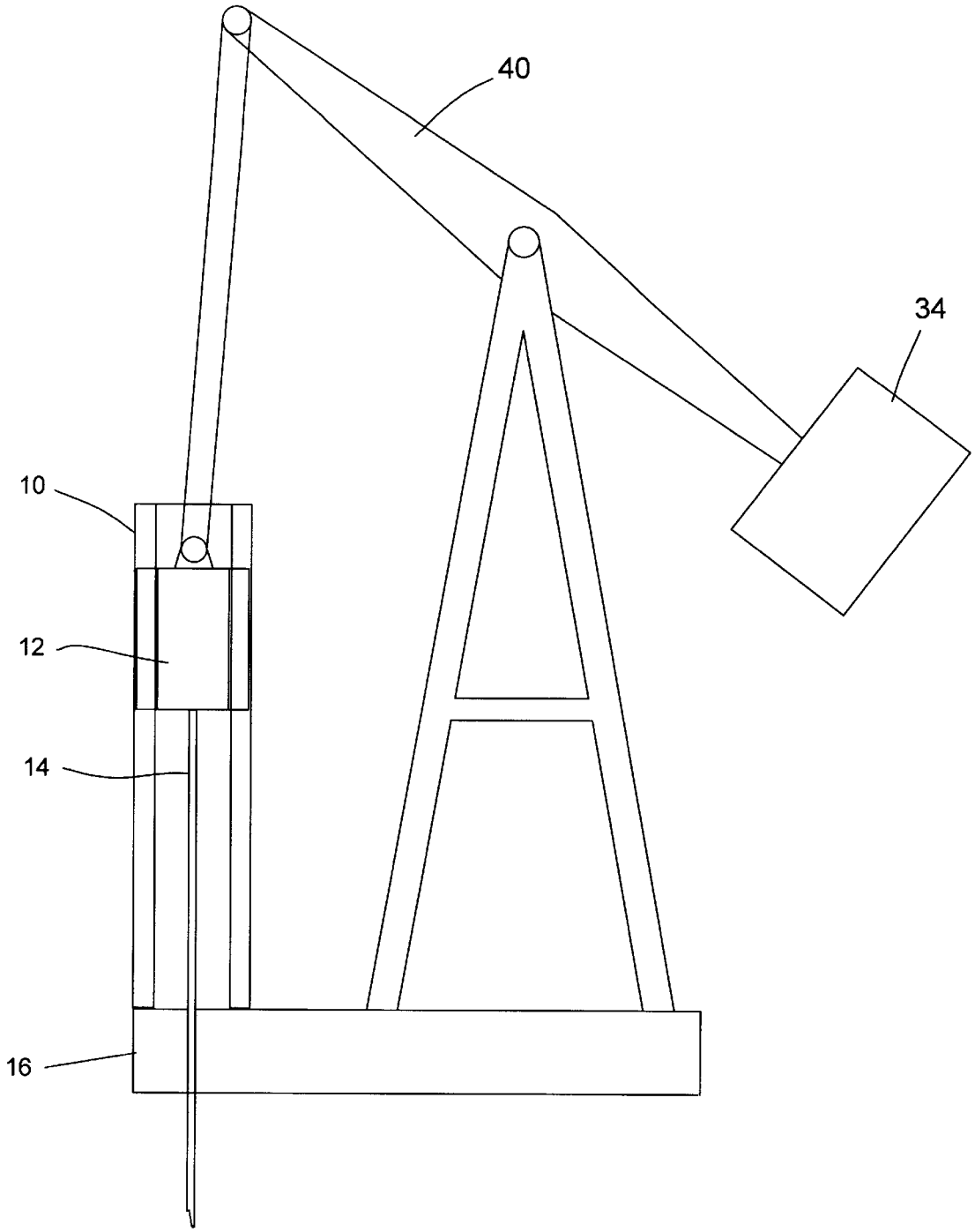
FIG. 10 provides a side view of a linear motor pump with a rocker arm counterbalance.

FIG. 10 provides a walking beam counterbalance that includes a rocker arm 40 attached to the armature 12 and a counterweight 34.

I claim:

1. A device for directly actuating a rod of a sucker rod pump assembly, the device comprising:

an electric linear motor, the motor including an armature, stators and a base and positioned about the axis of operation of the sucker rod pump, wherein the motor armature is connected to the top end of the rod; and a counterbalance in contact with the top end of the armature.

2. The device of claim 1, wherein at least a portion of the counterbalance is positioned between the armature and the base of the linear motor.

3. The device of claim 2, wherein the counterbalance includes a mechanical spring.

4. The device of claim 3, wherein one end of the spring contacts the armature and the other end contacts the base.

5. The device of claim 1, wherein the counterbalance includes a pneumatic cylinder.

6. The device of claim 1, wherein the counterbalance includes a hydraulic cylinder.

7. The device of claim 1, wherein the counterbalance includes a rocker arm counterweight.

8. The device of claim 1, wherein the counterbalance includes a flexible cable, one end of which is connected to the armature, an idler pulley which supports the cable and a counterweight fixed to the other end of the flexible cable.

9. The device of claim 1, wherein the linear motor is computer controlled.

10. A device for pumping fluid from a well, the device comprising:

a sucker rod pump assembly, the assembly including a rod;

an electric linear motor, the motor including an armature, stators and a base, and positioned such that it operates on substantially the same axis as the rod traverses, wherein the armature is connected to the top end of the rod; and a counterbalance positioned such that it counterbalances the weight of the sucker rod assembly and the liquid being pumped.

11. The device of claim 10, wherein the linear motor is computer controlled.

12. The device of claim 10, wherein at least a portion of the counterbalance is positioned between the armature and the base of the linear motor.

13. The device of claim 10, wherein the counterbalance is positioned below the linear motor.

14. A method for pumping a fluid utilizing a sucker rod assembly, an electric linear motor and a counterbalance, the sucker rod assembly including a rod and the electric linear motor including an armature, stators and a base, the method comprising:

positioning the sucker rod pump assembly such that the pump contacts a fluid reservoir;

positioning the linear motor such that its axis of operation is substantially the same as the axis of movement of the sucker rod;

attaching the top end of the sucker rod to the armature of the linear motor such that when operable the armature directly drives the rod;

providing a counterbalance positioned such that it alleviates the load imposed on the linear motor by the sucker rod and the column of fluid to be pumped; and operating the motor such that the pump acquires fluid on its down stroke and transports fluid on its up stroke.

15. The method of claim 14, wherein the fluid is oil.

16. The method of claim 14, wherein at least a portion of the sucker rod assembly is subsurface.

* * * * *